US007303489B2

(12) United States Patent
Gilbert et al.

(10) Patent No.: US 7,303,489 B2
(45) Date of Patent: Dec. 4, 2007

(54) GOLF CLUB

(75) Inventors: Peter J. Gilbert, Carlsbad, CA (US); Michael Scott Burnett, Carlsbad, CA (US); Raymond L. Poynor, Las Vegas, NV (US)

(73) Assignee: Acushnet Company, Fairhaven, MA (US)

( * ) Notice: Subject to any disclaimer, the term of this patent is extended or adjusted under 35 U.S.C. 154(b) by 300 days.

(21) Appl. No.: 11/206,629

(22) Filed: Aug. 18, 2005

(65) Prior Publication Data

US 2007/0042833 A1 Feb. 22, 2007

(51) Int. Cl.
*A63B 53/04* (2006.01)

(52) U.S. Cl. ..... 473/350; 473/347; 473/348; 473/345

(58) Field of Classification Search ..... None
See application file for complete search history.

(56) References Cited

U.S. PATENT DOCUMENTS 5,328,176 A 7/1994 Lo
6,805,543 B2 10/2004 Lin
6,805,643 B1 * 10/2004 Lin ..... 473/345
6,835,144 B2 12/2004 Best
6,942,580 B2 * 9/2005 Hou et al. ..... 473/332
7,125,343 B2 * 10/2006 Imamoto ..... 473/332
7,232,381 B2 * 6/2007 Imamoto et al. ..... 473/345

* cited by examiner

*Primary Examiner*—Eugene Kim
*Assistant Examiner*—Alvin A Hunter
(74) *Attorney, Agent, or Firm*—D. Michael Burns

(57) ABSTRACT

A golf club head and a method of making a golf club head includes a framework that is applied to the rear portion of the club head. A heat shrinkable membrane is mounted to the framework, by either mechanical means or by application of a bonding agent, creating a hollow golf club wherein the membrane material at the center of the rear portion is taut and exposed. The membrane is made from a conformable heat shrinkable fabric having a high tensile strength and negligible compressive strength. The fabric comprises thin, relative flexible, long interwoven fibers such as Kevlar, canvas, sailcloth and fabrics used in the skins of airplanes.

26 Claims, 2 Drawing Sheets

GOLF CLUB

FIELD OF THE INVENTION

The present invention relates generally to a hollow golf club head having a heat shrinkable membrane for a back surface and the method of making such a club head.

BACKGROUND OF THE INVENTION

The desire for perimeter weighting in a golf club iron is well known in the art. This desire stems from the fact that as the mass of the club is distributed towards the perimeter, the trajectory of the hit ball becomes more accurate, despite off-center hits away from the sweet spot of the golf club face or hitting surface. Consequently, many modern golf club irons have a rear cavity that extends towards the rear side of the face surface of the iron. The weight saved, by creating a rear cavity in the club, is re-distributed to the perimeter of the golf club head, and, the larger the cavity volume, the greater amount of mass of metal that may be redistributed to the perimeter of the golf club head.

Conventionally, golf club heads were made from a single material, usually stainless steel for some metal woods and iron type clubs, and recently the use of titanium for metal woods. Lightweight materials such as carbon fiber composites have been introduced, especially in metal woods, in an effort to decrease the weight of the golf club head while subsequently increasing the club head's volume. In iron type clubs, composite materials have been used widely to reinforce thin club faces, while providing "feel" and in some instances vibration dampening.

The manufacturers of hollow golf club heads have followed many paths, with the main focus being to have primarily perimeter weighting of the club head. Bladder molding is a popular method of manufacturing hollow club heads, while increasing the club head size and simultaneously maintaining the club head weight.

It is desirable to provide a golf club wherein the ease of hitting the ball is enhanced and wherein the simplicity of the manufacturing process utilizes lightweight materials.

SUMMARY

The present invention relates to a hollow golf club head having an upper portion and a sole portion defining a cavity therein. The cavity is enclosed by a framework that is comprised of a lightweight material such as aluminum or plastic which may be attached into a channel in rear surface of the club head. A heat shrinkable membrane is securely captured and stretched in the framework. The membrane maintains a tensioned shape regardless of typical operating temperatures or environmental exposures. The membrane has virtually no compressive strength.

The heat shrinkable membrane material has the characteristics found in such materials as canvas, Kevlar, sailcloth, airplanes etc. The membrane material is also relatively thin, flexible, and having long interwoven fibers which are strong in tensile strength.

The present invention presents a method of forming the hollow golf club wherein the membrane material is stretched in the framework by applying heat to a heat-shrinkable material prior to being attached to the club head. The framework may be secured by an epoxy or mechanical means.

The objectives of the golf club head of the present invention may be achieved in golf club heads, whether they be forged or cast.

DETAILED DESCRIPTION OF THE INVENTION

Figure 1:
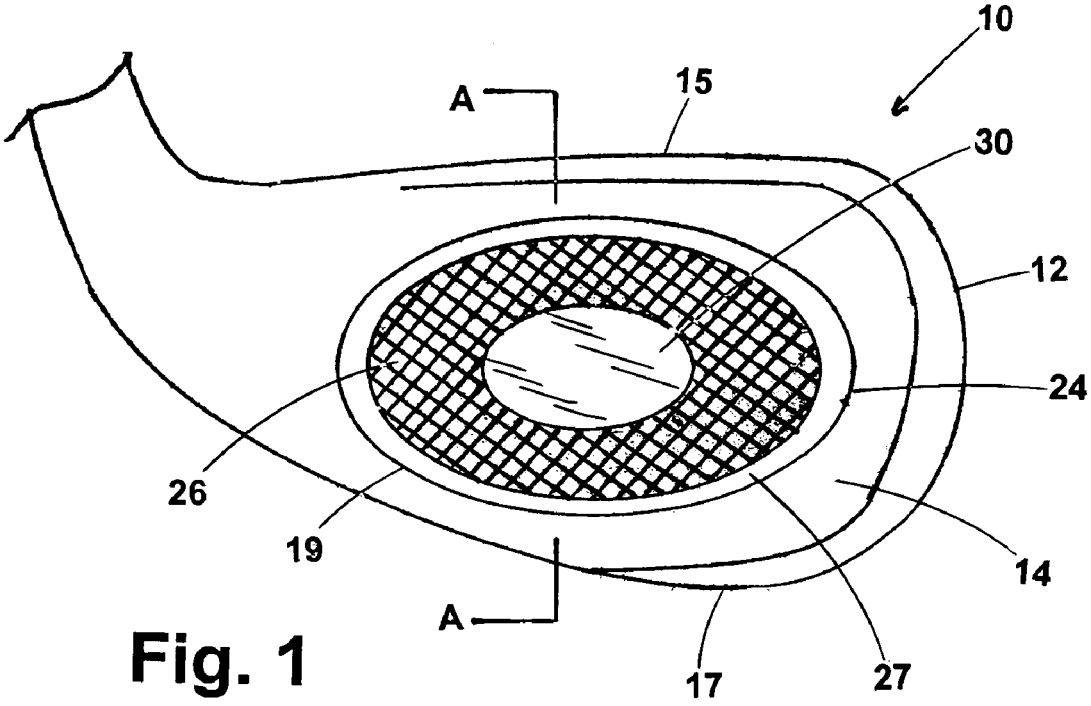
FIG. 1 is a rear view of a hollow club head of the present invention with the membrane section visible and forming substantially the entire rear portion of the club head.
Figure 2:
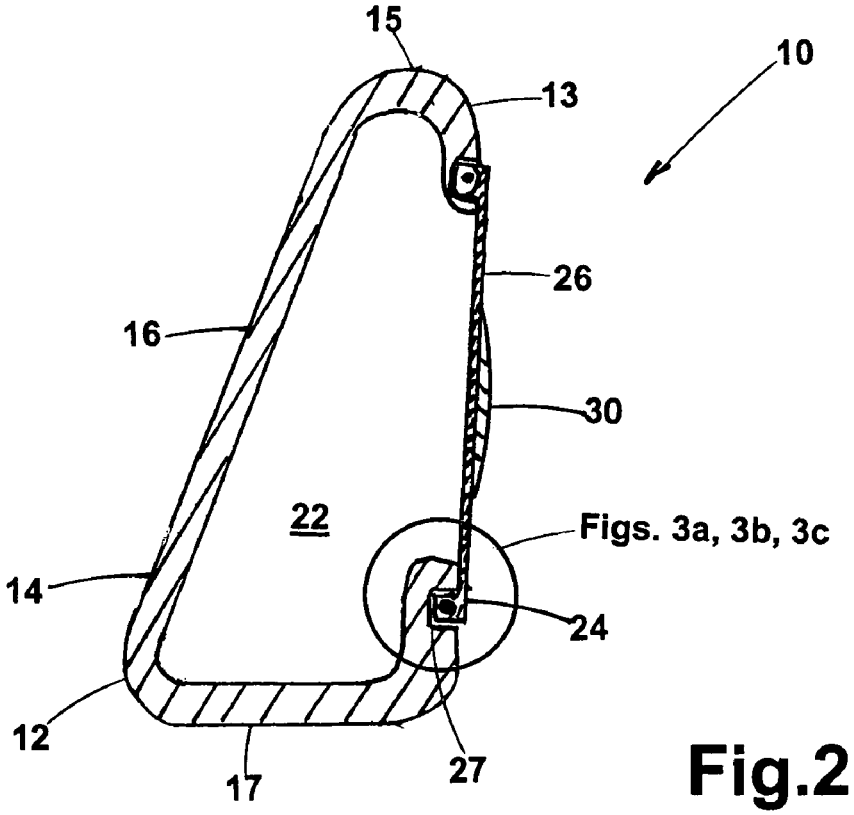
FIG. 2 is a cross section view of the club head along line A-A of FIG. 1.

An embodiment of a hollow iron golf club head 10 of the present invention is shown in FIGS. 1, 2, and 3*a*-3*c*. The golf club head 10 includes a body 12 which comprises a face portion 14 that includes a front face 16 for striking golf balls, an upper portion 15, a sole portion 17 defining a cavity 22 therein, and a rear surface 13 having a perimeter opening 19. The body 12 may be cast, forged, stamped or made by metal injection molding process. The body 12 has thinned down regions permitting the mass distribution optimization (Center of Gravity and Moment of Inertia) of the club head 10. The club head 10 also includes a lightweight framework 24 for enclosing the cavity 22. The framework 24 supports a conformable heat shrinkable membrane 26 that can sustain virtually no compressive stress, because the membrane 26 is made of a conformable fabric material of the type having the characteristics found in such materials as canvas, Kevlar®, sailcloth or the fabric used for some skins of airplanes. This type of material besides being stretchable or heat shrinkable is relatively thin, flexible, and includes long interwoven fibers that are strong in tensile strength. The framework 24 is made from such lightweight materials as aluminum or plastic, preferably plastic. One embodiment of the invention discloses the membrane 26 as being securely captured and stretched in the framework 24 by means of an injection molding process, wherein the membrane material is inserted into an injection molding tool, the tool closed and then a qualified plastic material is injected around and through the membrane to securely encompass the membrane into the framework shape. The edge of the framework 24 is of a size and configuration that it may be attached into a ledge 27 that is cut about the perimeter opening 19 of the rear portion of the body 12 by mechanical means, or it may also be attached and reinforced within the ledge 27 by a liquid epoxy or other suitable bonding agent. A decorative bezel can secure the outer edge of the framework. The membrane 26 may also be attached to the framework 24 mechanically and secured by an adhesive or screws and, when once mounted, it may be stiffened by the application of heat. Following the shrinking process, the membrane 26 will retain tensioned shape for typical operating temperatures or environmental exposures.

Figure 3A:
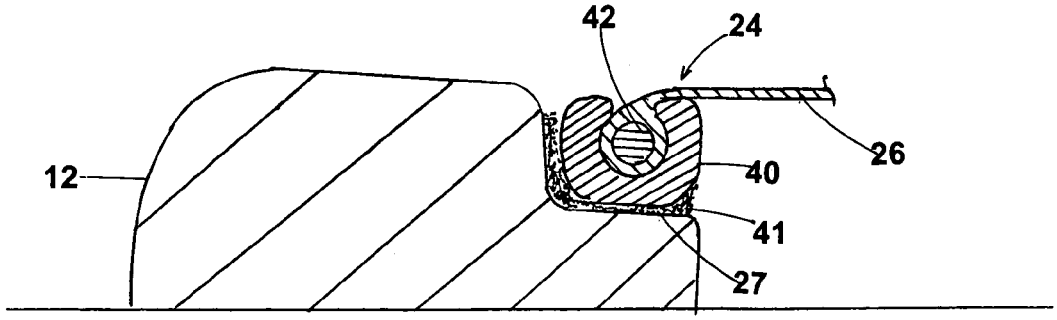
FIG. 3*a* is a detailed view of an embodiment for attaching the framework to the club head by means of a flexible clamp.

FIG. 3*a* shows an embodiment of the invention wherein the framework 24 has a flexible clamp 40 about the perimeter and is attached directly to the club head ledge 27 with an epoxy 41. The membrane 26 is attached to a ring 42 which is squeeze-fitted into the flexible clamp 40.

Figure 3B:
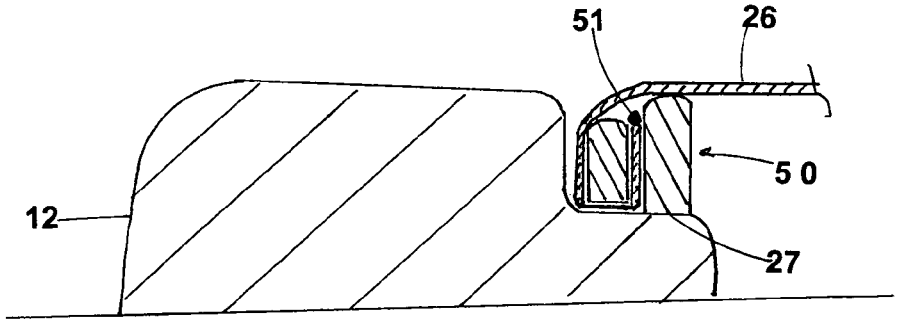
FIG. 3*b* is a detailed view of an embodiment of the invention wherein the framework is attached to the club head by a loom assembly.

FIG. 3*b* shows an embodiment wherein the framework 24 uses a loom ring assembly 50 to attach the framework 24 to the ledge 27. The perimeter of the membrane has a bead 51, which when secured in the loom ring assembly 50 secures the membrane 26 tautly with the framework 24. The loom ring assembly 50 is attached to the ledge 27 by an epoxy 41.

Figure 3C:
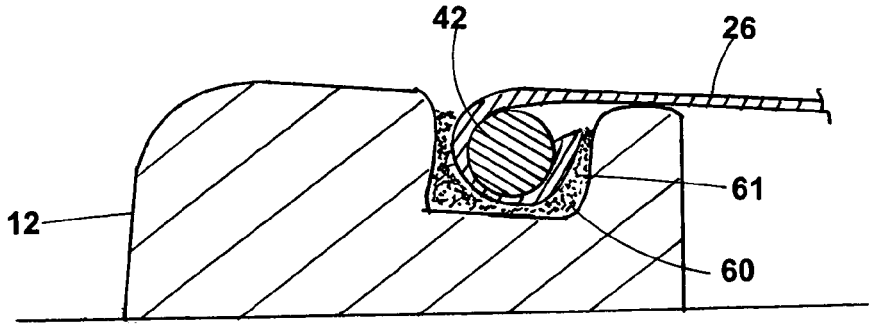
FIG. 3*c* is a detailed view of an embodiment of the invention wherein the framework is attached to the club head by an adhesive.

FIG. 3*c* shows another embodiment of the invention, wherein a channel 60 is defined about the perimeter opening 19, and the membrane 26 secured to a ring 42 as shown in FIG. 3*a*. The membrane 26 and ring 42 are then securely attached to the channel 60 by an adhesive 61.

An embodiment has a decorative medallion 30, possibly with a logo or some form of indicia, attached directly to the membrane 26 with the medallion 30 having a specific gravity heavier than the membrane 26, wherein the medallion 30 may provide a source of vibration dampening. This is taught in U.S. Pat. No. 6,835,144, issued to Best, and which is incorporated by reference herein in its entirety.

The membrane 26 is chosen from a material exhibiting the following property ranges: a shrink rate between 0 to 35% for a temperature range of 200° F. to 450° F.; a woven strength between 50 to 1100 lbs per inch; a woven flexural strength between about 20 to 450 MPa (million Pascals); a woven flexural modulus between about 2 to 45 GPa (billion Pascals); a density between 0.1 to 2.5 grams per cubic centimeter (g//cc); a yarn tenacity between about 2 to 40 g/d (tenacity is the tensile stress when expressed as force per unit linear density of the unrestrained material—grams-force per denier); and a yarn modulus between about 20 to 1600 g/d.

Once mounted on the club head 10, the membrane 26 is visible from the rear of the club head 10. The heating of the material creates a rear membrane surface that is taut across the framework 24.

While embodiments of the present invention focus on irons, it is to be appreciated that the same principles may be applied to a metal wood driver, such as placing a membrane on the crown section of the driver.

It is believed that those skilled in the pertinent art will recognize the improved inventive concepts of this invention. And they will readily understand that while the present invention has been described in association with a preferred embodiment thereof, and other embodiments illustrated in the accompanying drawings, numerous changes, modifications and substitutions of equivalents may be made therein without departing from the spirit and scope of this invention.

What is claimed is:

1. A hollow golf club head comprising:

a body formed from a material having a density, the body having a rear surface formed by an upper portion and a sole portion, the upper and sole portions defining a cavity therein;

the rear surface having a substantially oval shaped perimeter opening defined therein;

a framework supporting a conformable heat shrinkable membrane of density less than the body, the framework having a perimeter edge of a size and configuration for attaching about the perimeter opening;

means for attaching the framework to the rear surface; and the membrane being in a tensioned condition but having virtually no compressive strength, wherein the membrane is exposed through the rear portion and maintains a tensioned condition for varying temperatures and environmental exposures.

2. The golf club head according to claim 1, wherein the heat shrinkable membrane comprises thin, relatively flexible, long interwoven fibers being strong in tensile strength.

3. The golf club head according to claim 1, wherein the framework is constructed of aluminum.

4. The golf club head according to claim 1, wherein the framework is constructed of plastic.

5. The golf club head according to claim 1, wherein the membrane is securely captured and stretched in the framework by an injection molding process.

6. The club head of claim 1, wherein the membrane has a shrink rate of about 0 to 35% at a temperature range between about 200° F. to 450° F.

7. The club head of claim 1, wherein the membrane has a woven strength between 50 to 1100 pounds per inch.

8. The club head of claim 1, wherein the membrane has a woven flexural strength of about 20 to about 450 MPa.

9. The club head of claim 1, wherein the membrane has a woven flexural modulus of about 2 to 45 GPa.

10. The club head of claim 1, wherein the membrane has a density between 0.1 g/cc to 2.5 g/cc.

11. The club head of claim 1, wherein the membrane has a yarn tenacity of 2 to 40 g/d.

12. The club head of claim 1, wherein the membrane has a yarn modulus between about 20 to about 1600 g/d.

13. The club head of claim 1, wherein a decorative medallion is attached directly to the membrane, the membrane having a first specific gravity and the medallion having a second specific gravity greater than the first, wherein upon impact of the club head and a golf ball, a vibration dampening is created that will dampen unwanted vibrations.

14. The golf club head according to claim 1, wherein the attaching means comprises:

a ledge disposed about and in close proximity to the perimeter opening;

a loom ring assembly attached to the ledge and held in place with an epoxy;

the membrane secured within the framework and attached to the loom ring assembly; and a stop bead located at the perimeter edge of the membrane to prevent slippage out of the loom ring assembly.

15. A method of forming a hollow golf club head comprising the steps of:

providing a body having a cavity defined therein, and a substantially oval shaped perimeter opening defined in a rear surface;

providing a ledge about and in close proximity to the oval shaped perimeter opening;

providing a framework made from a lightweight material;

attaching a membrane to the framework;

heating the membrane causing it to be taut within the framework; and attaching the framework to the oval shaped perimeter opening to seal the cavity, wherein the membrane is visible on the rear surface and has a tensile strength but virtually no compressive strength.

16. The method of claim 15, wherein the framework comprises a lightweight material such as aluminum or plastic.

17. The golf club head according to claim 15, wherein the attaching means comprises:

a ledge disposed about and in close proximity to the perimeter opening;

a loom ring assembly attached to the ledge and held in place with an epoxy;

the membrane secured within the framework and attached to the loom ring assembly; and a stop bead located at the perimeter edge of the membrane to prevent slippage out of the loom ring assembly.

18. The method of claim 15, wherein heating the membrane includes heating a membrane material selected from a fabric that is thin, relatively flexible, and having long interwoven fibers which are very strong in tension.

19. The method of claim 18, wherein the attaching of the membrane to the framework is by an injection molding process.

20. The method of claim 18, wherein the membrane has a shrink rate of about 0 to 35% at a temperature range between about 200° F. to about 350° F.

21. The method of claim 18, wherein the membrane has a woven strength between 50 to 1100 pounds per inch.

22. The method of claim 18, wherein the membrane has a woven flexural strength of about 20 to about 450 MPa.

23. The method of claim 18, wherein the membrane has a woven flexural modulus of about 2 to 45 GPa.

24. The method of claim 18, wherein the membrane has a density between 0.1 g/cc to 2.5 g/cc.

25. The method of claim 18, wherein the membrane has a yarn tenacity of 2 to 40 g/d.

26. The method of claim 18, wherein the membrane has a yarn modulus between about 20 to about 1600 g/d.

* * * * *